US006332963B1

(12) United States Patent
Sakaki et al.

(10) Patent No.: US 6,332,963 B1
(45) Date of Patent: Dec. 25, 2001

(54) CUP-TYPE PLATING APPARATUS AND METHOD FOR PLATING WAFER USING THE SAME

(75) Inventors: Yasuhiko Sakaki, Hiratsuka; Mika Kurihara, Hadano, both of (JP)

(73) Assignee: Electroplating Engineers of Japan Limited, Tokyo (JP)

( * ) Notice: Subject to any disclaimer, the term of this patent is extended or adjusted under 35 U.S.C. 154(b) by 0 days.

(21) Appl. No.: 09/404,752

(22) Filed: Sep. 24, 1999

(51) Int. Cl.[7] ..... C25B 9/00

(52) U.S. Cl. ..... 204/266; 204/263; 204/224 R; 205/123; 205/148

(58) Field of Search ..... 204/224 R, 266, 204/252, 280, 286.1, 287, 263, 275.1; 205/148, 123, 122

(56) References Cited

U.S. PATENT DOCUMENTS 6,113,759 * 9/2000 Uzoh ..... 204/285

* cited by examiner

*Primary Examiner*—Bruce F. Bell
(74) *Attorney, Agent, or Firm*—Arent Fox Kintner Plotkin & Kahn, PLLC

(57) ABSTRACT

A cup-type plating apparatus includes a plating tank having a support section provided on an upper end thereof for holding a wafer; a solution feed section provided at the center of a bottom portion of the plating tank; an anode disposed within the plating tank; and a diaphragm for separating the anode from the wafer. The diaphragm is slanted upward from the solution feed section toward the periphery of the plating tank. A gas release port is provided in the plating tank at such a position as to release bubbles collected under an upper end portion of the diaphragm.

3 Claims, 1 Drawing Sheet

CUP-TYPE PLATING APPARATUS AND METHOD FOR PLATING WAFER USING THE SAME

BACKGROUND OF THE INVENTION

1. Field of the Invention

The present invention relates to a technique for plating semiconductor wafers, and more particularly to a cup-type plating apparatus.

2. Description of the Related Art

Conventionally, a cup-type plating apparatus is a known apparatus for plating semiconductor wafers. In the cup-type plating apparatus, a wafer is placed on an upper end portion of a plating tank, and a plating solution is fed in the form of an ascending flow from a lower portion of the plating tank toward a surface-to-be-plated of the wafer (hereinafter referred simply as a "wafer surface") to thereby plate the wafer surface. Being suitable for automation of a small-lot production or plating process, the cup-type plating apparatus is in wide use.

However, the cup-type plating apparatus involves the following two problems. First, film, such as black film, formed on the surface of an anode during plating exfoliates to become impurities in the plating solution. The impurities are carried in the ascending flow of the plating solution and reach the wafer surface, causing nonuniform plating.

Second, in the case where an insoluble anode is used, an additive added for control of plating performance is consumed in significant amounts. The reason is that use of an insoluble anode causes decomposition of the additive present in the vicinity of the insoluble anode although dissolution of an anode metal into the plating solution does not occur. Such an additive-consuming phenomenon not only complicates plating process control but also increases plating cost.

A conceivable solution to the above two problems is installation of a diaphragm within the plating tank; that is, partitioning of the interior of the plating tank into an anode-side chamber and a wafer-side chamber. Employment of such a diaphragm is disclosed in, for example, Japanese Utility Model Application Laid-Open (kokai) No. 36529/1987 and Japanese Patent Application Laid-Open (kokai) Nos. 242797/1989 and 154989/1992.

According to Japanese Utility Model Application Laid-Open (kokai) No. 36529/1987 and Japanese Patent Application Laid-Open (kokai) No. 242797/1989, the diaphragm is disposed within the plating tank and above an anode in such a manner as to cover the entire surface of the anode. This diaphragm can prevent mixing of impurities generated from the anode in a plating solution that ascends toward a wafer surface. Also, since the anode is separated from the wafer surface, the consumption of additive can be reduced in the case where an insoluble anode is used. However, in the case where the plating solution is fed at a certain position, the thus-arranged diaphragm may interrupt a direct ascending flow of a plating solution. As a result, the plating solution fails to flow smoothly. Further, bubbles and impurities generated from the anode stagnate under the diaphragm, which is disposed horizontally within the plating tank, thereby preventing stable supply of plating current.

According to Japanese Patent Application Laid-Open (kokai) No. 154989/1992, the interior of a plating tank is partitioned into an upper wafer-side chamber and a lower anode-side chamber by means of a diaphragm. These chambers are fed with a plating solution separately from each other. Through feed of the plating solution into the anode-side chamber, bubbles and impurities flow with the flowing plating solution and thus are less likely to stagnate under the diaphragm. Nevertheless, impurities and bubbles are apt to stagnate under the horizontally disposed diaphragm. Although the plating solution is fed into the upper and lower chambers separately from each other, the plating solution flowing out from the upper chamber and that flowing out from the lower chamber are mixed in a single plating solution storage tank. As a result, the impurity content of the plating solution increases, which has an adverse effect on plating.

SUMMARY OF THE INVENTION

In view of the foregoing, an object of the present invention is to improve a conventional cup-type plating apparatus having a diaphragm and to provide a cup-type plating apparatus capable of preventing impurities generated from an anode from affecting plating, suppressing the consumption of additive in a plating solution, which would occur upon use of an insoluble anode, and reliably ejecting bubbles generated from the anode, as well as to provide a method for plating a wafer by use of the apparatus.

To achieve the above object, the present invention provides a cup-type plating apparatus comprising: a plating tank having a wafer support section provided on an upper end of the plating tank and adapted to hold a wafer; a solution feed section provided at the center of a bottom portion of the plating tank; an anode disposed within the plating tank; and a diaphragm for separating the anode from the wafer. The diaphragm is slanted upward from the solution feed section toward the periphery of the plating tank. A gas release port is provided in the plating tank at such a position as to release bubbles collected under an upper end portion of the diaphragm.

According to a typical structure of a cup-type plating apparatus, the solution feed section is provided at the center of the bottom portion of the plating tank and is adapted to feed the plating solution in the form of an ascending flow, and the anode is disposed to surround the solution feed section. Through disposition of the diaphragm in such a manner as to be slanted upward from the solution feed section toward the periphery of the plating tank as practiced in the present invention, the interior of the plating tank is partitioned into an anode-side chamber and a wafer-side chamber. Accordingly, impurities generated from the anode do not reach the wafer surface. Also, in the case where an insoluble anode is used, the consumption of additive can be reduced. Further, bubbles generated from the anode during plating flow along the upward slanted diaphragm and are collected under the upper end portion of the diaphragm. The thus-collected bubbles are released to the exterior of the plating tank through the gas release port provided under a connecting portion between the diaphragm and the plating tank. Accordingly, the bubbles neither reach the wafer surface nor stagnate under the diaphragm.

The diaphragm used in the present invention is not particularly limited, and a diaphragm used in an ordinary plating process may be used. In order to effect sufficient separation in terms of the plating solution, a porous diaphragm is preferred. The type of diaphragm and the size of pores may be selected in consideration of a plating solution and additive employed.

According to the cup-type plating apparatus of the present invention, in order to maintain good plating conditions over a long period of time, separate solution circulation passages are provided so as to avoid mixing a solution fed into an anode-side chamber defined in the interior of the plating tank by the diaphragm, and a solution fed from the solution feed section toward the wafer. Accordingly, the solution fed toward the wafer, i.e., a plating solution, is not oxidized by the anode, and the consumption of additive in the plating solution is suppressed. Also, impurities generated from the anode are not mixed in the plating solution, thereby facilitating control of the plating solution.

Preferably, when plating is performed by use of the cup-type plating apparatus of the present invention, an electrolytic solution that contains ions of a metal to be plated onto a wafer is fed from the solution feed section toward the wafer, whereas an electrolytic solution that does not contain ions of a metal to be plated onto the wafer is fed into the anode-side chamber, thereby preventing the electrolytic solutions from mixing. As a result, there can be reduced the consumption of the electrolytic solution that contains ions of a metal to be plated onto the wafer; i.e., the consumption of a plating solution, thereby yielding a cost advantage. Also, since the composition of the electrolytic solution fed into the anode-side chamber can be adjusted freely, a reducing agent, for example, may be added to the electrolytic solution so as to suppress generation of bubbles from the anode. In this case, the plating solution fed toward the wafer may also be fed into the anode-side chamber. The electrolytic solution that does not contain ions of a metal to be plated onto the wafer is exemplified as follows: in the case where a copper sulfate solution is used as an electrolytic solution fed toward the wafer, an aqueous solution of sulfuric acid serves as the electrolytic solution that does not contain ions of Cu to be plated onto the wafer. The above description should not be construed as limiting the present invention. The above and other objects, advantages, features, and applications of the present invention will become more apparent from the following description given in conjunction with the accompanying drawing. Also, it is to be understood that modifications are possible without departing from the spirit of the invention and that such modifications are encompassed in the scope of the invention.

DESCRIPTION OF THE PREFERRED EMBODIMENT

Figure 1:
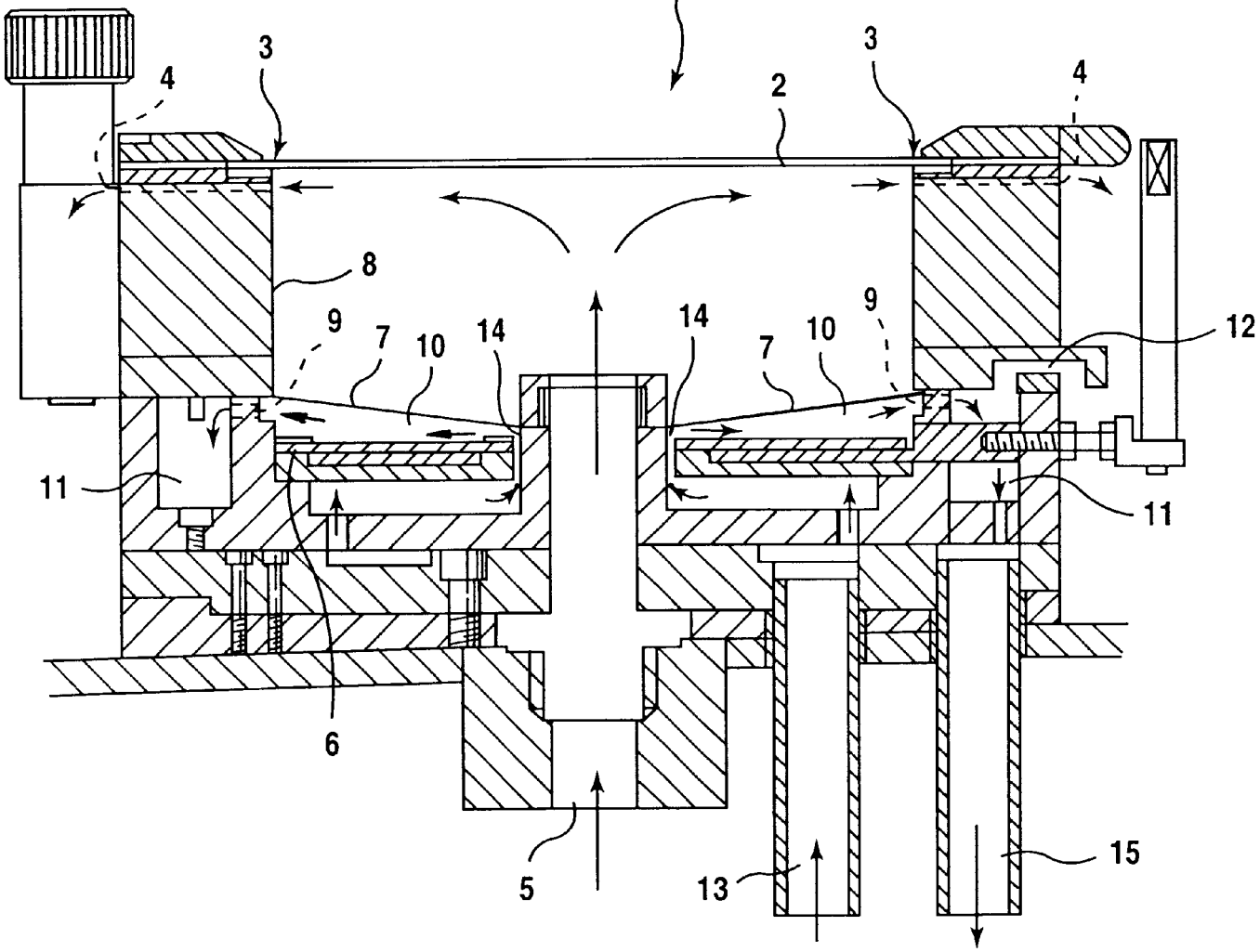
FIG. 1 is a sectional view showing a cup-type plating apparatus according to an embodiment of the present invention.

An embodiment of the present invention will be described in detail with reference to the drawing. FIG. 1 schematically shows the structure of a cup-type plating apparatus according to the present embodiment. As shown in FIG. 1, the cup-type plating apparatus includes a plating tank 1. The plating tank 1 has a wafer support section 3 allowing placement of a wafer 2 on an upper opening portion of the plating tank 1 and capable of connecting the placed wafer 2 to an unillustrated cathode; a plating-solution outlet 4 located under the wafer support section 3 and extending between the interior and the exterior of the plating tank 1; a plating-solution feed port 5 provided at the center of a bottom portion of the plating tank 1; and an insoluble anode (made of Pt/Ti) 6 connected to an unillustrated power supply.

A diaphragm 7 is disposed in such a manner as to be slanted upward from a surrounding region around the plating-solution feed port 5 toward the periphery of the plating tank 1, and is connected to an inner wall surface 8 of the plating tank 1. A gas release port 9 is provided under a connecting portion between an upper end portion of the diaphragm 7 and the inner wall surface 8, and is adapted to release bubbles generated from the anode 6 and collected under the upper end portion of the diaphragm 7. The diaphragm 7 partitions the interior of the plating tank 1 into a chamber on the wafer 2 side and a chamber 10 on the anode 6 side. The plating tank 1 further includes a solution reservoir 11 for receiving an electrolytic solution flowing out of the chamber 10 through the gas release port 9, and an auxiliary port 12 located above a portion of the solution reservoir 11 and adapted to eject to the exterior of the plating tank 1 bubbles that have been released through the gas release port 9.

An electrolytic solution is fed into the chamber 10 through an electrolytic solution feed port 13 provided at the bottom portion of the plating tank 1. The electrolytic solution gradually fills a cavity located under the anode 6, passes through a gap 14 provided around the plating-solution feed port 5, and then fills the chamber 10. After filling the chamber 10, the electrolytic solution flows out into the solution reservoir 11 through the gas release port 9. The electrolytic solution collected in the solution reservoir 11 is ejected through an electrolytic solution outlet 15 provided in the solution reservoir 11 and is sent to an unillustrated electrolytic solution storage tank. The electrolytic solution fed into the chamber 10 and the plating solution fed through the plating-solution feed port 5 flow through different solution circulation passages so as not to mix together.

The cup-type plating apparatus according to the embodiment and a cup-type plating apparatus not having the diaphragm were tested for the consumption of additive. The test results are described below. Table 1 shows the test conditions and an employed evaluation method.

TABLE 1

| Plating solution | Copper sulfate solution |
|---|---|
| Electrolytic solution | Copper sulfate solution (same composition as that of the plating solution) |
| Plating solution temperature | Room temperature |
| Additive | Brightner(sulfur-containing additive) |
| Current density | 1 A/dm$^2$ |
| Diaphragm | PTFE 0.1 "m thick (hydrophilic Teflon) |
| Evaluation method | The additive concentration in the plating solution is obtained through CVS analysis to thereby calculate the consumption of additive per unit of current and time. |

Table 2 shows results of a test performed in relation to the consumption amount of additive. In the cup-type plating apparatus according to the present embodiment, a copper sulfate solution serving as a plating solution for the wafer 2 was also used as an electrolytic solution to be fed into the chamber 10. A copper sulfate solution having an initial additive concentration of 2.0 ml/l was fed through the electrolytic solution feed port 13 to fill the chamber 10. A copper sulfate solution having an initial additive concentration of 2.0 ml/l was fed toward the wafer 2 in the form of an ascending flow through the plating-solution feed port 5. The wafer 2 underwent plating for a predetermined time. After plating, the amount of additive in the copper sulfate solution contained in the chamber 10 and the amount of additive in the copper sulfate solution contained in the wafer 2 side chamber were measured through CVS (Cyclic Voltammetric Stripping) analysis. On the basis of the measurements, the consumption of additive was calculated. The same test was conducted by use of the conventional cup-type plating apparatus not having the diaphragm 7. Specifically, the wafer underwent plating for a predetermined time by use of a copper sulfate solution having an initial additive concentration of 2.0 ml/l. Subsequently, the copper sulfate solution was analyzed for the amount of additive, followed by calculation of the consumption of additive. The copper sulfate solutions used in the test have the same copper concentration and the same sulfuric acid concentration.

TABLE 2

| | Diaphragm provided | | Diaphragm not provided |
|---|---|---|---|
| Additive | Consumption ml/Ahr | | Consumption ml/Ahr |
| | (1) | (2) | |
| Brightner | 3.7 | 13.4 | 11.4 |

(1): Copper sulfate solution fed toward wafer
(2): Copper sulfate solution in anode side chamber As seen from Table 2, in the cup-type plating apparatus according to the present embodiment, the consumption of additive in the copper sulfate solution fed toward the wafer (represented by (1) in Table 2) is suppressed significantly as compared to the case of the cup-type plating apparatus not having the diaphragm. Also, the wafer plated by use of the cup-type plating apparatus according to the present embodiment exhibited excellent appearance of plating.

The test has revealed that the cup-type plating apparatus of the present invention can prevent impurities generated from an anode from affecting plating, suppress the consumption of additive in a plating solution, which would occur upon use of an insoluble anode, and reliably eject bubbles generated from the anode.

What is claimed is:

1. A plating apparatus, comprising:

a plating tank having a wafer support section provided on an upper end of said plating tank and adapted to hold a wafer;

a solution feed section provided at the center of a bottom portion of said plating tank;

an anode disposed within said plating tank; and a diaphragm for separating said anode from the wafer, said diaphragm being slanted upward from said solution feed section toward the periphery of said plating tank, said plating tank further having a gas release port provided at such a position as to release bubbles collected under an upper end portion of said diaphragm.

2. The plating apparatus according to claim 1, further comprising separate solution circulation passages provided so as to avoid mixing a solution fed into an anode-side chamber that is defined in the interior of said plating tank by means of said diaphragm, and a solution fed from said solution feed section toward the wafer.

3. A method for plating a wafer with a first electrolytic solution and a second electrolytic solution by use of a plating apparatus according to claim 2, comprising the steps of:

feeding said first electrolytic solution that contains ions of a metal to be plated onto the wafer, from said solution feed section toward the wafer; and feeding said second electrolytic solution that does not contain ions of a metal to be plated onto the wafer, into an anode-side chamber that is defined in the interior of said plating tank by means of said diaphragm.

* * * * *